United States Patent [19]

Hella et al.

[11] Patent Number: 4,787,547

[45] Date of Patent: Nov. 29, 1988

[54] MOUNTING MEANS FOR AIR BARS

[75] Inventors: Terry A. Hella; Paul H. Stibbe, both of DePere, Wis.

[73] Assignee: Advance Systems, Inc., Oneida, Wis.

[21] Appl. No.: 61,327

[22] Filed: Jun. 11, 1987

[51] Int. Cl.[4] ..... B65H 20/14; F26B 13/20

[52] U.S. Cl. ..... 226/97; 34/156

[58] Field of Search ..... 226/97; 34/156, 160; 248/291

[56] References Cited

U.S. PATENT DOCUMENTS

| | | | |
|---|---|---|---|
| 1,585,490 | 5/1926 | Hainsworth | 248/291 X |
| 3,344,270 | 9/1967 | Ryder | 248/291 X |
| 3,739,491 | 6/1973 | Creapo et al. | 34/156 |
| 3,763,571 | 10/1973 | Vits | 226/97 X |
| 3,776,440 | 12/1973 | Frost et al. | 34/156 X |
| 3,964,656 | 6/1976 | Hella | 226/97 |
| 4,197,973 | 4/1980 | Daane | 226/97 |
| 4,425,719 | 1/1984 | Klein et al. | 34/156 |

*Primary Examiner*—Stuart S. Levy
*Assistant Examiner*—Lynn M. Sohacki
*Attorney, Agent, or Firm*—James E. Nilles

[57] ABSTRACT

Apparatus for drying a running paper web and floatingly suspending it without contact during the drying process, including air bars which are spaced apart from one another along each side of the web and are fed with pressurized air for a supply duct. The air bars have an air supply opening, and the supply ducts have an air feed neck adapted to be inserted in said air bar supply openings for directing pressurized air thereto, O-ring type seals are located between the bar openings and the duct feed necks to permit relative sealing movement between the bars and supply duct an angular adjustment between said air bar and the duct permits tilting of the bars longitudinally relative to the web to vary the angle of the air discharge against the web.

9 Claims, 4 Drawing Sheets

MOUNTING MEANS FOR AIR BARS

BACKGROUND OF THE INVENTION

1. Field of the Invention

The invention relates to air bars for floatingly guiding and suspending advancing a paper web of indeterminate length and relates specifically to mounting means for such air bars.

2. Background Information

Air bars utilized in web drying equipment of the type to which the present invention pertains must be accurately adjusted relative to their distance from the web in order to properly suspend the web and float it without flutter. Generally the air bars are adjusted relative to the web by moving the entire upper bank of air bars relative to the web and/or moving the entire bank of lower air bars relative to the web. Such adjustments are shown in the U.S. patents to Creapo et al U.S. Pat. No. 3,739,491, issued June 19, 1973, or U.S. Pat. No. 3,776,440 to Frost et al, issued Dec. 4, 1973. While these adjusting devices for the air bars did perform satisfactorily, certain situations arose wherein the individual air bars required adjustment relative to the web or relative to the other air bars. Furthermore, certain of the air bars required that they be adjusted as to the angle of discharge against the web, that is, special air bars such as air foils caused web flutter under certain circumstances.

The above two patents utilize sealing means for the air bars relative to their air supply headers which were known as the race track type sealing gaskets in which the oval shaped gaskets carried by the air bars simply abutted against flanges on the air supply headers and did not provide for any adjustment between the air bars and the headers, more particularly did not provide any individual adjustment of the air bars relative to the web.

SUMMARY OF THE INVENTION

The present invention provides web drying equipment having means for sealingly mounting the air bars on the air supply duct means so that the bars can be individually adjusted toward and away from the web. Another aspect of the invention relates to sealing means for mounting the air bars relative to the web and on their duct means so that the air bar can be tilted or pivoted to change the angle of the drying air being discharged against the web. More specifically, the invention provides a pivot mount for an air bar so that the angle between the top or outer wall of the air bar and the web line can be adjusted to eliminate web flutter. The air bar can be adjusted in a range of plus or minus ten degrees from a "neutral" position, to result in a quieter web and contribute greatly to web stability.

Still another aspect of the invention relates to adjustable air bars of the above type which will support a web in an arcuate path and thereby contribute to its quietness and stability without flutter.

These and other objects and advantages will appear hereinafter as this disclosure progresses, reference being had to the accompanying drawings.

DESCRIPTION OF A PREFERRED EMBODIMENT

Figure 1:
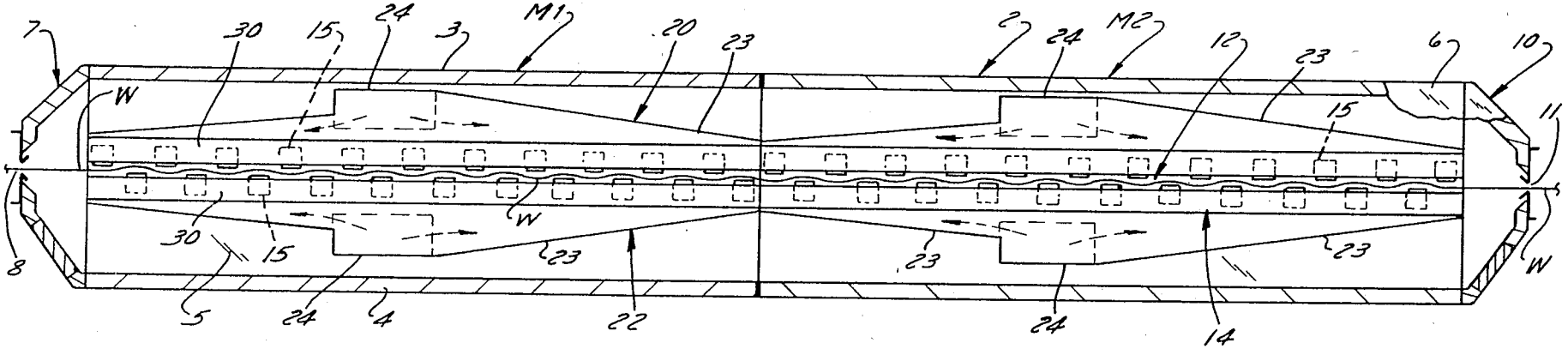
FIG. 1 is a vertical cross-sectional view taken along the length of a web drying apparatus embodying the present invention, the view being generally schematic in nature.

Web drying apparatus for floatingly suspending a running web is shown in FIG. 1 and includes an elongated dryer housing 2 which is enclosed by its insulated top 3, insulated bottom 4, one insulated side 5 and an opposite insulated side 6. An insulated inlet end 7 has a horizontal slot 8 through which the web W enters. The opposite, exit end is formed by the insulated end wall 10 and a corresponding slot 11 therein through which the web exits. In the FIG. 1 showing, two similar housing modules M1 and M2 are joined together end to end. A single module may be used in some installations. The length of a module may vary, for example, from eleven to twenty feet, but a length of twelve to fourteen feet would be average.

The arrangement includes an upper air bar assembly 12 and a lower air bar assembly 14 between which the web W passes. Assemblies 12 and 14 each have a series of air bars 15 located in spaced apart relationship along each of the upper and lower sides of the web and these bars are transversely positioned across the web. It will be noted that the upper air bars are in staggered, spaced relationship along the web with respect to the lower air bars to thereby cause the web to assume a conventional sine wave form when in operation, as shown.

Figure 2:
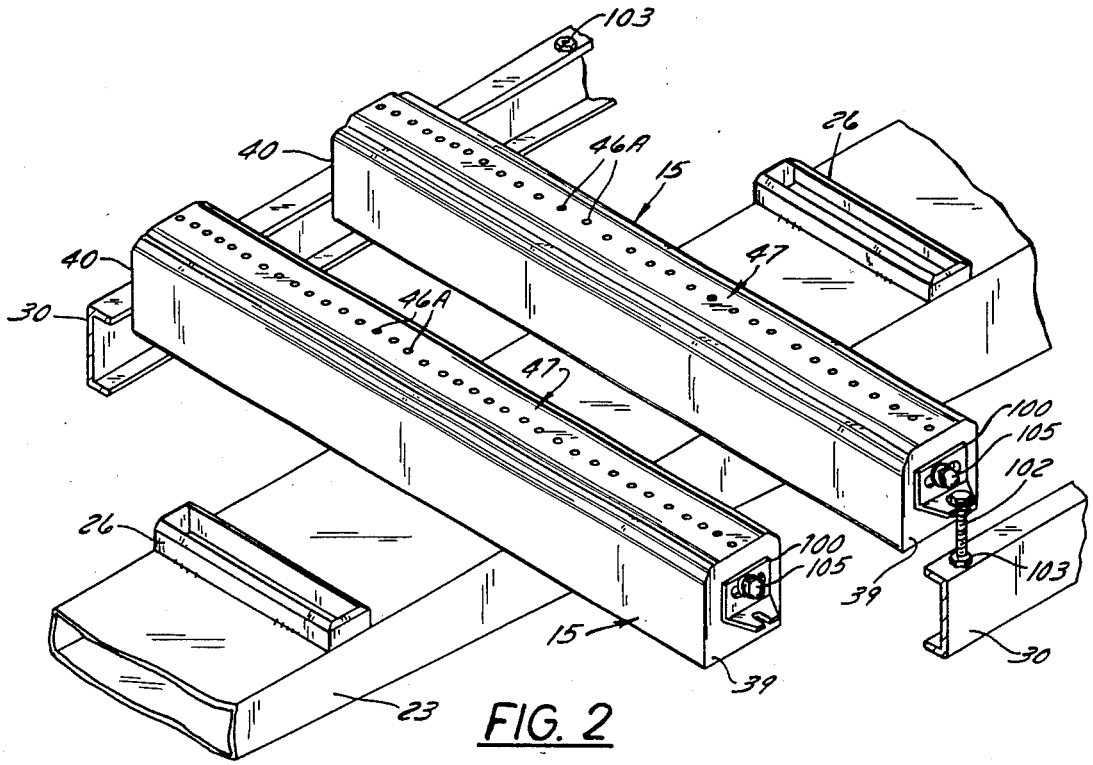
FIG. 2 is a fragmentary, enlarged view of a portion of the apparatus shown in FIG. 1, certain parts being removed for the sake of clarity in the drawings, and showing a pair of air bars as they are mounted on the lower duct means.

An air supply duct means 20 is provided for each module of the upper air bars 15 while a similar air supply duct means 22 is provided for the lower set of air bars 15. These duct means include the longitudinally extending ducts 23 that extend from the central supply duct 24. The ducts 23 each have a series of air feed necks 26 (FIGS. 2 and 3) extending transversely thereacross and at spaced locations along their length. An air bar 15 is in air receiving communication with each of the necks 26 and thus the air supply ducts furnish pressurized air to each of the air bars for ultimate discharge against the web to floatingly support the latter.

The air supply duct means includes the header frame 30 which is mounted within the housing and acts to support the air supply system.

Figure 3:
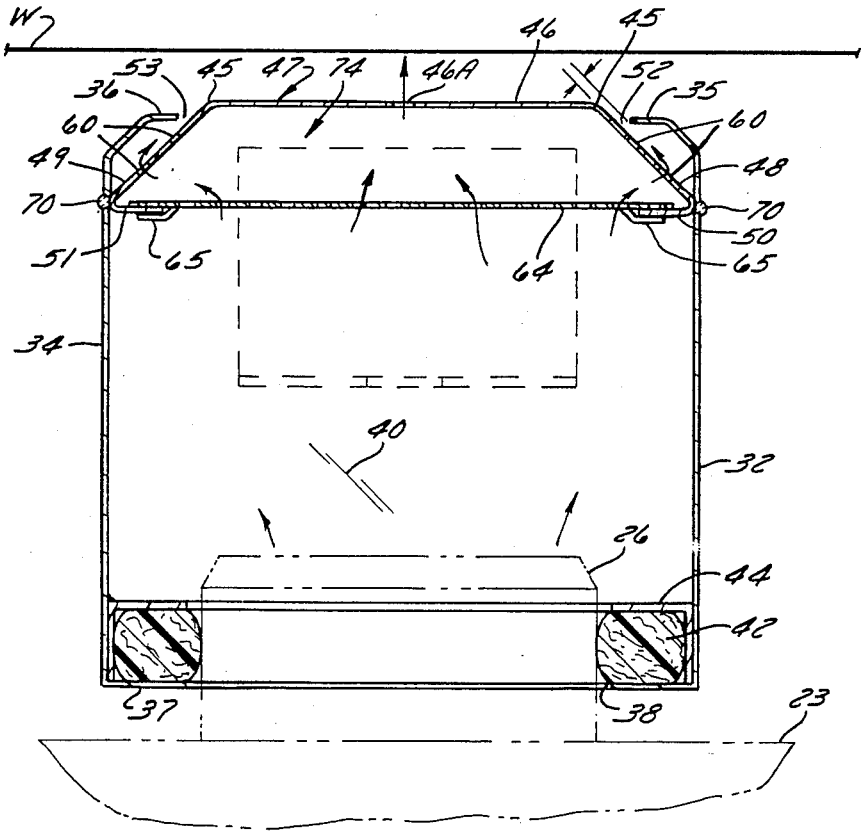
FIG. 3 is a transverse cross-sectional view through one of the air bars shown in FIGS. 1 and 2, but on an enlarged scale.

The air bar shown in detail in FIG. 3 includes the side walls 32, 34 which terminate at their upper ends in the inwardly turned flanges 35, 36, respectively.

The air bars also have end walls 39 and 40 which are welded at the ends of the bars.

Figure 4:
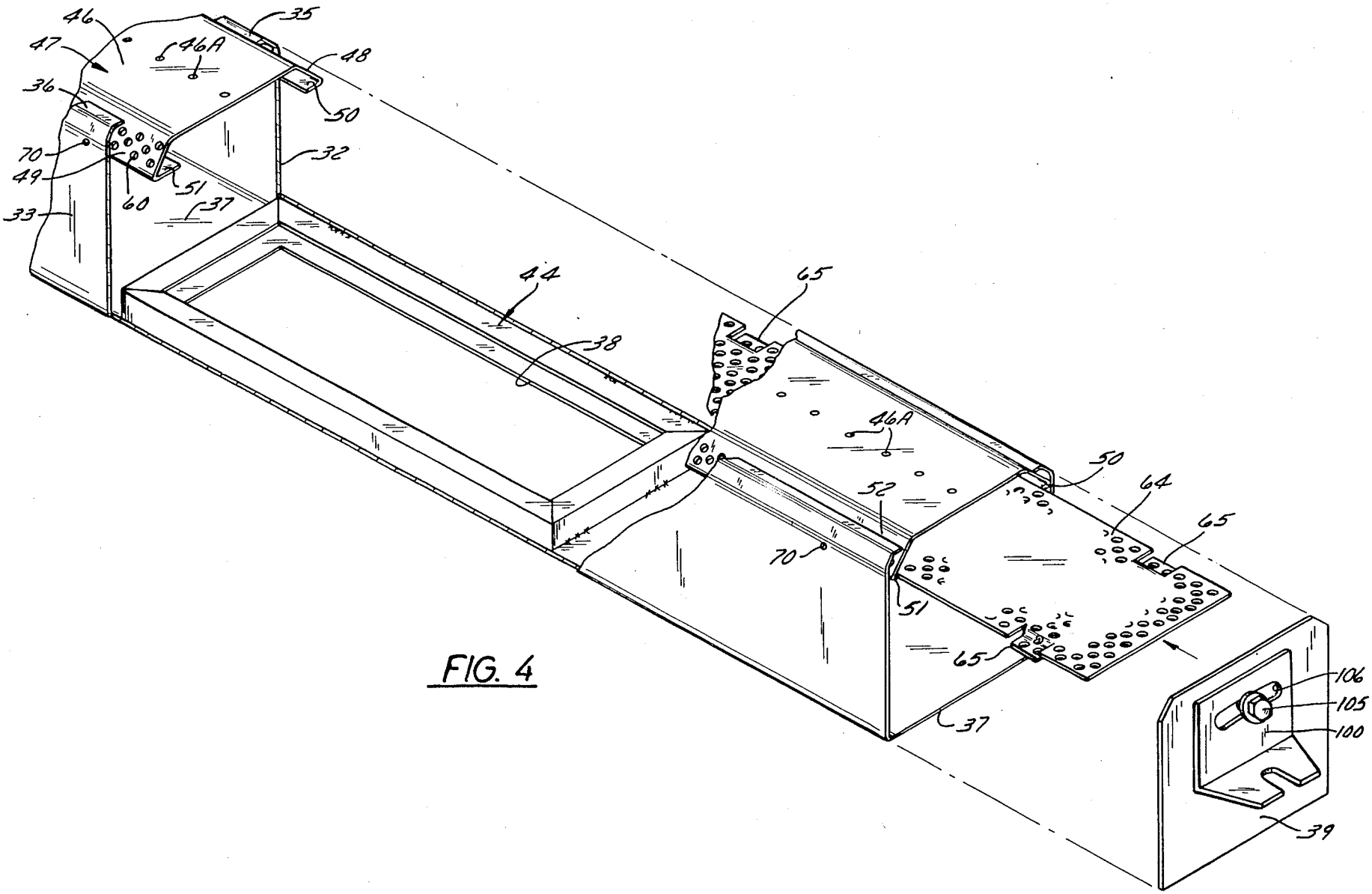
FIG. 4 is a perspective, exploded, fragmentary view of a portion of the air bar shown in the other figures.

The air bars also have a lower wall 37 formed between the side walls and in which a rectangular opening 38 is formed for the purpose of receiving the air feed neck 26 of the duct means. It will be noted that an O-ring type seal 42 is provided in the U-shaped (in cross section) gasket retainer 44 of rectangular form (FIG. 4).

The retainer has the open side of its C-shape facing inwardly and is located around the opening 38 in inner wall 37 of the air bar. The seal 42 is located in the C-shape form of the retainer and acts to sealingly embrace the side walls of neck 26 of the duct means when the air bar is assembled on the duct means. With this telescoping joint between the air bar and the duct means, the air bars can be adjusted toward and away from the web to thereby precisely locate the bar in respect to the web. This joint also permits the duct to expand or contract, due to the temperature differentials encountered, without disturbing the setting of the air bars relative to the web. The joint also insures easy and accurate assembly of the bars on their duct. As will later appear, this joint also permits angular adjustment of the bars, and particularly of the discharging air, with respect to the web.

The standard air bar (shown in FIGS. 2, 3, 4 and 6) also includes an upper wall 46 (referred to as the air bar face) which is located adjacent the web. This wall 46 may have a center row of air discharge holes 46A for furnishing additional air to the web, if needed.

The wall or bar face 46 is part of the air distributing member 47 which also includes the inclined walls 48 and 49 and the inner, inwardly turned flanges or lips 50 and 51. The angle at the juncture 45 of walls 46 and inclined walls 48 and 49 is made having as sharp a break in the sheet metal as possible, so as to preclude a Coanda effect of the discharging air.

A perforated plate 64 has a series of depressed tabs 65 (FIGS. 3 and 4) pressed therefrom and spaced along the length of plate 64 so that the perforated plate is slidably engageable along the inwardly turned flanges 50 and 51. The member 47 is rigidly secured within the air bar by means of welding plugs 70 along each of its sides and by means of which it is securely fastened to the side walls 32 and 34 of the air bar. Thus, the tabs 65 and flanges 50 and 51 form guide means for slidably supporting the perforated plate 64. The bifurcations formed by the tabs 65 on the perforated plate provide an easily manufactured and readily assembled perforated distribution plate.

In operation, pressurized air is introduced from the duct supply means into the interior of the air bar via the neck 26 of the ducts and then the air flows through the perforated plate 64 which causes it to be evenly distributed within the equalizing chamber 74 of the air bar and without appreciable cross currents. Then the pressurized air passes through the small apertures 60 of the inclined portions and through the discharge slot nozzles 52 and 53 against the web, at an angle of about 45°.

The wall or face 46 of the opposed upper and lower air bars are spaced apart a distance of about three-eighths of an inch. In other words, the walls 46 of the upper air bars are spaced from the corresponding surfaces of the lower air bars three-eighths of an inch under normal circumstances. When the dryer is in operation, the web assumes a sine wave form as shown in FIG. 1 and under those circumstances the web is actually a distance of about three-eighths of an inch from the air bar walls 46.

With the angular adjustment shown for the standard air bar 15, the upper wall 46 would be parallel to the theoretical web line when in the neutral position. The angle of the air bar face or wall 46 can be varied preferably in a range from plus to minus ten degrees from the neutral position.

Figure 5:
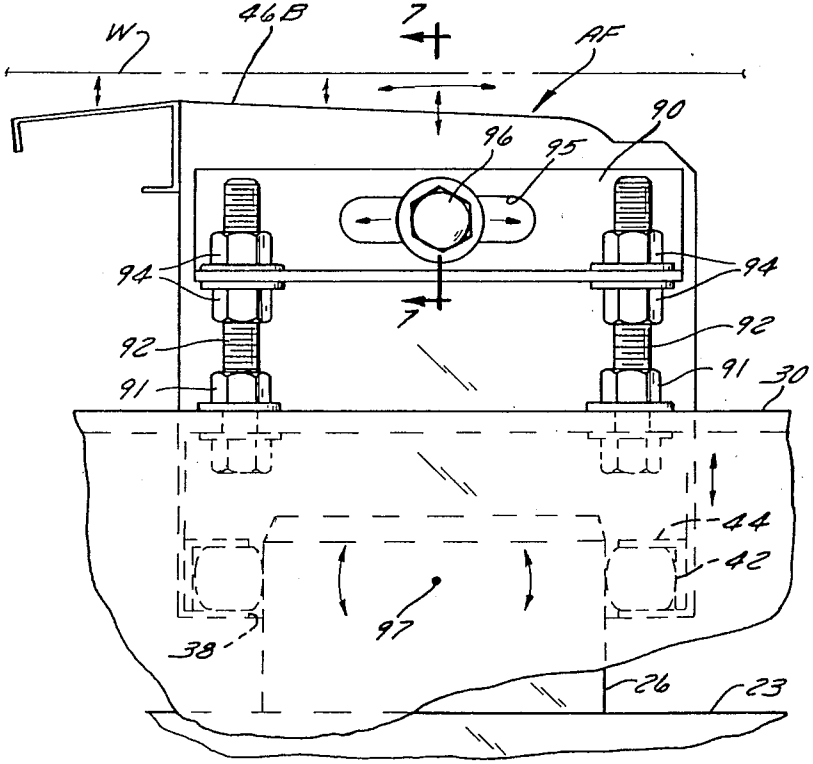
FIG. 5 is an end elevational view of an adjusting means for an air bar of the air foil type.

FIG. 5 illustrates an improved adjusting means for an air foil type air bar AF, when the air foil is positioned in a neutral position, i.e., with an angle of about three degrees with respect to the theoritical web line. The air foil is like that shown in FIG. 13 of U.S. Pat. No. 4,197,973, issued Apr. 15, 1980 to Robert A. Daane. The air foil face 46B (FIG. 5 is preferably adjusted angularly with respect to the web line in a range of about ten degrees in either direction from neutral.

The adjusting means for such an air foil is possible with the use of the O-ring sealing means and air duct neck construction previously referred to. An adjusting means of this character is located at each end of the air bar. An angle iron bracket 90 is bolted by bolt means 96 across each end of the air bar. A pair of adjustable jacking bolt means 92 are secured to the header frame 30 by nuts 91 and extend upwardly through the bracket 90 and are held in place by the pair of nuts 94. In order to adjust the AF toward and away from the web, the bolt 96 is tightened and nuts 94 are adjusted on bolts 92.

A slot 95 is provided through the bracket 90 and bolt means 96, secured to the end of the air bar (FIG. 7), extends through the slot 95. The angle of the air bar relative to the web W can be adjusted by loosening bolts 96 and then tilting the air bar about the effective pivot point 97 to the desired angular position. When the desired angle of the bar has been attained, the bolts 96 are tightened. It will be noted that the O-ring type seal 42 bearing against the neck 26 can accommodate any angular movement of the bar. Thus, the angle of the bar outer wall 46B can be accurately adjusted relative to the web. The air bar of the air foil type can thus be adjusted angularly to result in a quieter web that contributes to web stability.

Thus, with the arrangement of FIG. 5, the air foil can be adjusted toward and away from the web by means of the jacking bolts 92 and the O-ring type seal and neck 26 arrangement. The bar can also be adjusted angularly with respect to the web by means of the jacking bolt 96.

Figure 6:
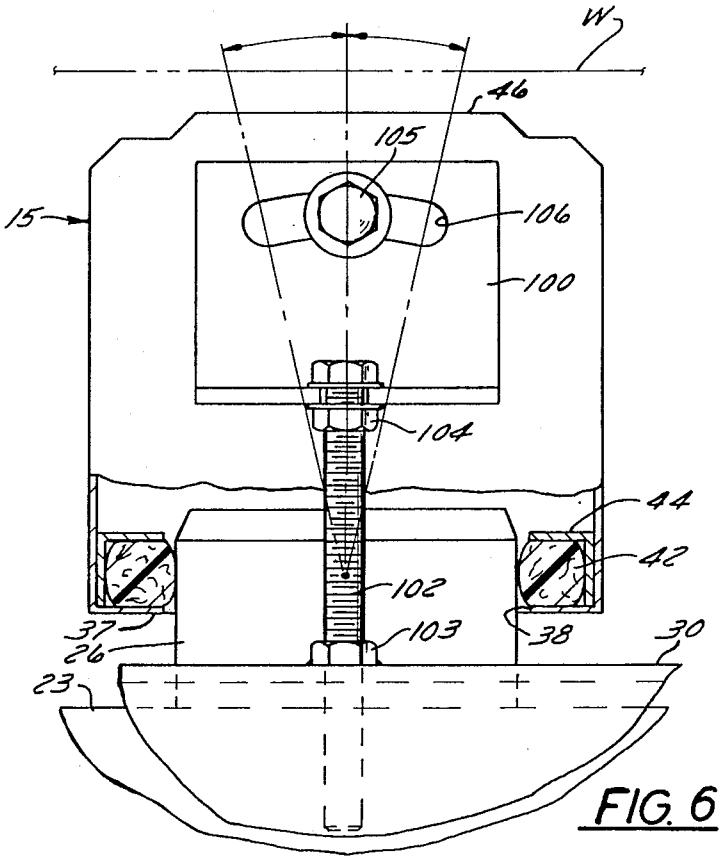
FIG. 6 is an end elevational view of another adjusting means for an air bar of the standard type.

FIG. 6 shows the adjustment means for the air bar 15 previously described. In this instance the bracket 100 is adjustably bolted by means 105 to each end of the air bar and a jacking bolt 102 is fixed to the header frame 30 by means of the nut 103 which is welded to the header frame 30. The jacking bolt 102 can thus be adjusted in nut 103 for adjusting the distance of the air bar 15 toward and away from the web W.

Figure 7:
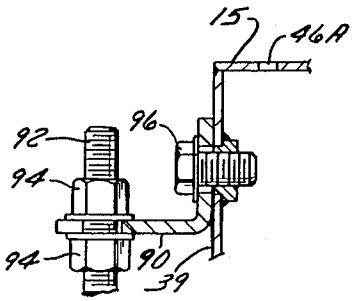
FIG. 7 is a sectional view taken along line 7—7 in FIG. 5.

In order to angularly adjust the bar 15 relative to the web, as previously described, the clamping bolt 105 extends through the slot 106 and is fixed in the end of the air bar, as is the bolt 96 of FIG. 7. The bolt 105 can be loosened to permit tilting or rotating of the air bar to the adjusted angular position and then bolt 105 is tightened to clamp the air bar in such position. This swinging or pivotal movement of the air bar is permitted by the gasket 42 and duct neck 26 previously described.

What is claimed as the invention is:

1. Paper web dryer apparatus of the type having an elongated housing through which a web is floatingly suspended as it moves through the housing, a series of elongated air bars located transversely across said web and in spaced apart relation along both the upper and lower sides of the web for directing air against the web for drying and supporting said web, said air bars having air nozzle slots at their side adjacent said web and through which air is directed, and said bars also have an air supply opening at their side opposite said slots, an air supply duct means for said upper air bars and also an air supply duct means for said lower bars, and said duct means have an air feed neck extending therefrom and which are adapted to be inserted in said bar supply openings for directing pressurized air thereto, said duct air feed necks having side walls, and O-ring type seal means mounted on said bars and located between said bar openings and said side walls of said duct feed necks, said seal means sealingly embracing said side walls to permit relative sliding and continuous sealing movement between said bars and duct means feed necks, whereby a telescoping joint is formed between said bars and their duct means to permit said bars to shift in their duct means and in a direction toward and away from said web.

2. Paper web dryer apparatus of the type having an elongated housing through which a web is floatingly suspended as it moves through the housing, a series of elongated air bars located transversely across said web and in spaced apart relation along both the upper and lower sides of the web for directing air against the web for drying and supporting said web, and an air supply duct means for said upper air bars and also an air supply duct means for said lower bars, a telescoping joint between said bars and their duct means to permit said bars to shift in their duct means and in a direction toward and away from said web, O-ring type seal means located between said air bars and their duct means for sealing therebetween, and including angular adjustment means between said air bar and said duct means for tilting said bars longitudinally relative to said web to varying the angle of the air discharge against said web.

3. Apparatus set forth in claim 1 including angular adjustment means between said air bar and said duct means for tilting said bars longitudinally relative to said web to varying the angle of the air discharge against said web.

4. Apparatus described in claim 2 wherein said angular adjustment means includes jacking bolt means between said bar and said duct means for adjustably and fixedly varying the relative position between said bars and said web.

5. Apparatus described in claim 3 wherein said angular adjustment means includes jacking bolt means between said bar and said duct means for adjustably and fixedly varying the relative position between said bars and said web.

6. Apparatus set forth in claim 1 including a C-shaped gasket retainer fixed in said bar at their said side opposite said slots and which retainer is located around said air supply opening, said C-shaped retainer having an open side facing inwardly around said air supply opening, said O-ring type seal is located within said C-shaped retainer for sealing abutment with the said neck extending into said retainer.

7. Apparatus set forth in claim 2 including a C-shaped gasket retainer fixed in said bar at their said side opposite said slots and which retainer is located around said air supply opening, said O-ring type seal is located with said C-shaped retainer for sealing abutment with the said neck extending into said retainer.

8. Paper web dryer apparatus of the type having an elongated housing through which a web is floatingly suspended as it moves through the housing, a series of elongated air bars located transversely across said web and in spaced apart relation along both the upper and lower sides of the web for directing air against the web for drying and supporting said web, said air bars having air nozzle slots at their side adjacent said web and through which air is directed, and said bars also have an air supply opening at their side opposite said slots, an air supply duct means for said upper air bars and also an air supply duct means for said lower bars, and a telescoping joint between said air bars and their respective air supply duct means and so constructed and arranged so as to permit relative movement therebetween while simultaneously ensuring an air seal therebetween, said telescoping joint including an air feed neck having a side wall and an O-ring type flexible seal which slidably and sealingly embraces said feed neck side wall.

9. The apparatus described in claim 8 including angular adjustment means between said air bars and said duct means for tilting said bars longitudinally relative to said web, said telescoping joint maintaining said seal during said tilting.

* * * * *